US006886522B1

(12) United States Patent
Lawrence

(10) Patent No.: US 6,886,522 B1
(45) Date of Patent: May 3, 2005

(54) CYLINDER BLOCK AND METHOD OF FABRICATION THEREOF

(75) Inventor: Howard J. Lawrence, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 09/959,220

(22) PCT Filed: May 5, 2000

(86) PCT No.: PCT/GB00/01594

§ 371 (c)(1),
(2), (4) Date: Oct. 17, 2001

(87) PCT Pub. No.: WO00/68559

PCT Pub. Date: Nov. 16, 2000

(30) Foreign Application Priority Data

May 7, 1999 (GB) ..... 9910659

(51) Int. Cl.[7] ..... F02F 7/00
(52) U.S. Cl. ..... 123/195 R
(58) Field of Search ..... 123/41.74, 195 R, 123/195 A, 195 H, 195 S; 29/888.61, 888.6, 557, 527.5, 888.01; 164/100, 47, 58.1, 9

(56) References Cited

U.S. PATENT DOCUMENTS

| | | | | | |
|---|---|---|---|---|---|
| 4,554,893 | A | | 11/1985 | Vecellio | |
| 4,712,517 | A | * | 12/1987 | Anno et al. | 123/195 R |
| 5,016,584 | A | * | 5/1991 | Inoue et al. | 123/195 R |
| 5,564,381 | A | * | 10/1996 | Wiesen | 123/195 S |
| 5,771,955 | A | * | 6/1998 | Helgesen et al. | 164/9 |
| 6,125,811 | A | * | 10/2000 | Koriyama et al. | 123/195 A |

FOREIGN PATENT DOCUMENTS

| | | | | |
|---|---|---|---|---|
| CA | 1 270 166 | | 6/1990 | |
| DE | 4324609 | | 1/1995 | |
| DE | 4341040 | | 6/1995 | |
| DE | 195 40 763 | | 12/1996 | |
| DE | 297 23 356 | U1 | 8/1998 | |
| DE | 297 10 830 | U1 | 10/1998 | |
| EP | 0 368 478 | | 5/1990 | |
| GB | 2 140 502 | A | 11/1984 | |
| GB | 2 168 430 | | 6/1986 | |
| JP | 63-120839 | A * | 5/1988 | 123/195 R |
| JP | 02112654 | | 4/1990 | |
| WO | 94/12784 | | 6/1994 | |

* cited by examiner

*Primary Examiner*—Henry C. Yuen
*Assistant Examiner*—Hyder Ali
(74) *Attorney, Agent, or Firm*—John J Cheek

(57) ABSTRACT

A method for fabricating a cylinder block for an internal combustion engine and a cylinder block manufactured in accordance with the method are described in which a cylinder core (1) including one or more cylinder (6) is manufactured by casting, for example from steel or light alloy; the remainder of the cylinder block structure is manufactured as a wrought framework (2), for example in high strength low allow steel or light alloy; and the wrought framework (2) is joined to the core (1).

33 Claims, 17 Drawing Sheets

CYLINDER BLOCK AND METHOD OF FABRICATION THEREOF

The present invention relates to a method for manufacturing an internal combustion engine cylinder block, a cylinder block produced by the method and an engine including the cylinder block.

For many years advantage has been taken of the high mechanical strength of cast iron in the production of internal combustion engine cylinder blocks. In more recent years, cast aluminium alloys have been used in place of cast iron in some engines to give savings in engine weight but aluminium alloys carry the disadvantages of lower mechanical strength and higher coefficient of thermal expansion when compared with cast iron.

There is a relationship between engine weight and fuel usage in engines employed to provide motive power and this relationship becomes especially important where the engine forms a significant proportion of the overall vehicle weight. Engine weight can, for example, impact on compliance with the Corporate Average Fuel Economy (CAFE) passenger car regulations presently in force in the United States and Japan and likely to be introduced in a similar form in Europe and elsewhere. The relationship between engine weight and fuel usage is, of course, also important for other on-highway and off-highway motive power applications.

The cylinder block is a major contributor to engine weight and is therefore a prime target for weight reduction. However, high mechanical strength of engine cylinder blocks is becoming an increasing necessity in order to facilitate, for example, conformity of the cylinder to piston interface to control emissions emanating from this area. High mechanical strength also assists in attenuation of vibrations and hence noise emissions.

In the material selection process for conventional cylinder blocks, a choice is likely to be made between the high strength but substantial weight of a cylinder block produced as an iron casting and the reduced weight but lower strength of a cylinder block cast in an aluminium alloy. Neither material in isolation can offer any more than a compromise for conventional cylinder blocks.

For reasons given above, it is particularly desirable for the cylinder block of an internal combustion engine to have a very high stiffness in the region of the cylinder bores coupled with a generally high overall stiffness and low overall weight.

Benefits are also envisaged where the cylinder block of an engine fitted to a passenger vehicle can be configured to deform plastically in an impact and thereby contribute to the vehicle crumple performance. The advantage of a vehicle body structure that will deform at a predetermined rate and manner in a severe impact has long been recognised. However, controllably deformable cylinder blocks have not hitherto been developed which can form a part of such a controllably deformable body structure.

It is desirable that a cylinder block having the aforementioned advantages will be relatively easy and economical to manufacture and that this remains the case in volumes down to less than fifty thousand per annum in order to cater for both high volume on-highway and low volume off-highway vehicles.

It may be desirable further for a cylinder block to be easily configurable externally to suit different vehicle or static installations during high or low volume production for maximum manufacturing flexibility. For example, in engines which are of generally similar construction but are to be installed either in road vehicles or in generating sets, the cylinder blocks could be built with a common core but configured externally with engine mounting points and transmission housing adaptation dedicated to the intended installation.

Thus, according to a first aspect of the invention, a method for fabricating a cylinder block for an internal combustion engine comprises the following steps: a cylinder core including one or more cylinders is manufactured by casting; the remainder of the cylinder block structure is manufactured as a wrought framework; the wrought framework is joined to the core.

The core may be cast in steel or in a light alloy. The framework may be fabricated from high strength low alloy steel, or from a light alloy.

A preferred means of joining the framework to the core is by welding, especially by a technique such as laser welding. Tags and/or slots may be provided. Alternative means of joining the frame components to the core include brazing and adhesive bonding.

The cast core is designed to react all internal loads (gas pressure, bearing loads etc.) whilst the frame reacts engine mounting and torque loads, and provides attachment for various external parts. The selection of a cast structure for the core and a wrought, fabricated structure for the remainder of the cylinder block, ensures that material properties for each load bearing requirement are optimised, and that the advantages of these two materials as set out above are exploited to the full. In consequence, the resultant structure offers better strength and stiffness to weight performance than is possible in cylinder blocks of conventional construction.

The structure of the core is preferably kept as simple as possible, to facilitate after casting processing (for example shot blasting for improved fatigue resistance if required, cleaning, inspection and machining). Nevertheless, in addition to the cylinders, the core is preferably cast to include a lower coolant jacket, and may also include an upper coolant jacket which together with the lower coolant jacket defines a coolant gallery, upper main bearing supports, support means for a cylinder head, and support means for lubricating oil pressure rail and the like. In a preferred arrangement, an upper deck is provided which comprises both the upper coolant jacket and the support means for a cylinder head. The wrought frame may include a wrought outer coolant jacket adapted to cooperate with the core as a closure for the coolant gallery. The cylinder block may include internal fluid passages formed as metallic tubes bonded into the cast core.

The core is preferably cast to provide for a plurality of cylinders, each of which is siamesed (that is, joined to its adjacent cylinder for substantially a full cylinder length). It is established that siamesing of engine cylinders provides improved structural rigidity whilst minimising the pitch between cylinder bores, which can be a factor affecting noise, vibration and harshness (NVH) performance.

In one embodiment, the structure is fabricated to provide engagement means within the cylinder block to engage a cylinder head, and engagement means to engage the cylinder block in position on a lower part of an engine, such as the main bearing caps. Preferably, these means provide full, ready-access engagement and disengagement in situ.

These may take the form of separate fasteners to fasten the cylinder block to the cylinder head and to fasten the cylinder block on to a lower part of the engine. However, in a preferred arrangement, the cylinder block is fabricated so as to be provided with engagement means to facilitate through fastening of a cylinder head to a lower part of an engine, thus retaining the block in position.

The cylinder block apparatus preferably includes captive fasteners to minimise screw thread machining operations.

The method preferably includes the further step of attaching enclosure panels to the cylinder block to form an enclosed structure. The enclosure panels may include noise attenuation means. Since the enclosure panels do not need to have a major load bearing function, they can be of lighter weight material. Accordingly, in a preferred arrangement the fabricated framework of the cylinder block is an open framework structure, and in particular the crankcase area is an open framework structure, the framework being subsequently closed by attachment of light-weight enclosure panels. In this open framework arrangement, the enclosure panels may also function as fluid retention jackets for the retention of engine fluids.

In a further preferred step of the fabricating method, stiffening rails may be provided within the fabricated framework to increase the stiffness and frequency mode of the cylinder block apparatus. The stiffening rails may be in the form of upper and/or lower lateral rails, which may be pre-loaded, whereby the structure is plastically pre-deformed to resist distorting forces, for example by the application of deformation in situ subsequent to fabrication. Alternatively or additionally, a diagonal brace may be welded to the side of the fabricated apparatus to produce additional stiffness.

The cylinder block may be fabricated to possess controlled zones of deformation, so as to serve as part of the crumple zone of a vehicle on which it is fitted.

In accordance with further aspects of the present invention, the method comprises the fitment of the above described cylinder block as part of an internal combustion engine, and the fitment of such an engine onto a vehicle.

In accordance with a further aspect of the present invention, a cylinder block for an internal combustion engine comprises a cast cylinder core including one or more cylinders and a wrought cylinder block framework comprising substantially the remainder of the cylinder block which is joined to the cast core.

Further features of the cylinder block in accordance with the invention will be understood by analogy with the further features described above for the method of its fabrication.

In accordance with further aspects, the invention comprises an internal combustion engine to which is fitted the above described cylinder block, and a vehicle fitted with said engine.

The invention therefore provides a method for fabricating a cylinder block for an internal combustion engine having high block strength and stiffness, particularly in the region of the cylinder bore, with reduced overall weight, and a cylinder block having such properties.

The method for fabricating a cylinder block for an internal combustion engine entails a low capital investment.

The method facilitates fabrication of a cylinder block for an internal combustion engine which can be controllably deformable so as to serve as part of a vehicle crumple zone, and also provides a cylinder block having such properties.

The cylinder block for an internal combustion engine may be structurally configured to adapt to different vehicle or static engine installations.

A cylinder block apparatus of the invention can include captive fasteners to minimise screw thread machining operations.

A cylinder block apparatus of the invention can also include through fastening of the cylinder head to a lower part of the engine.

By way of example, the invention will be described with reference to the accompanying drawings, of which:

FIG. 11(*b*) is a second isometric view of the coolant jacket side panel of FIG. 10;

FIG. 12(*b*) is a second isometric view of the alternative coolant jacket side panel to which has been assembled an enclosure panel;

Figure 1:
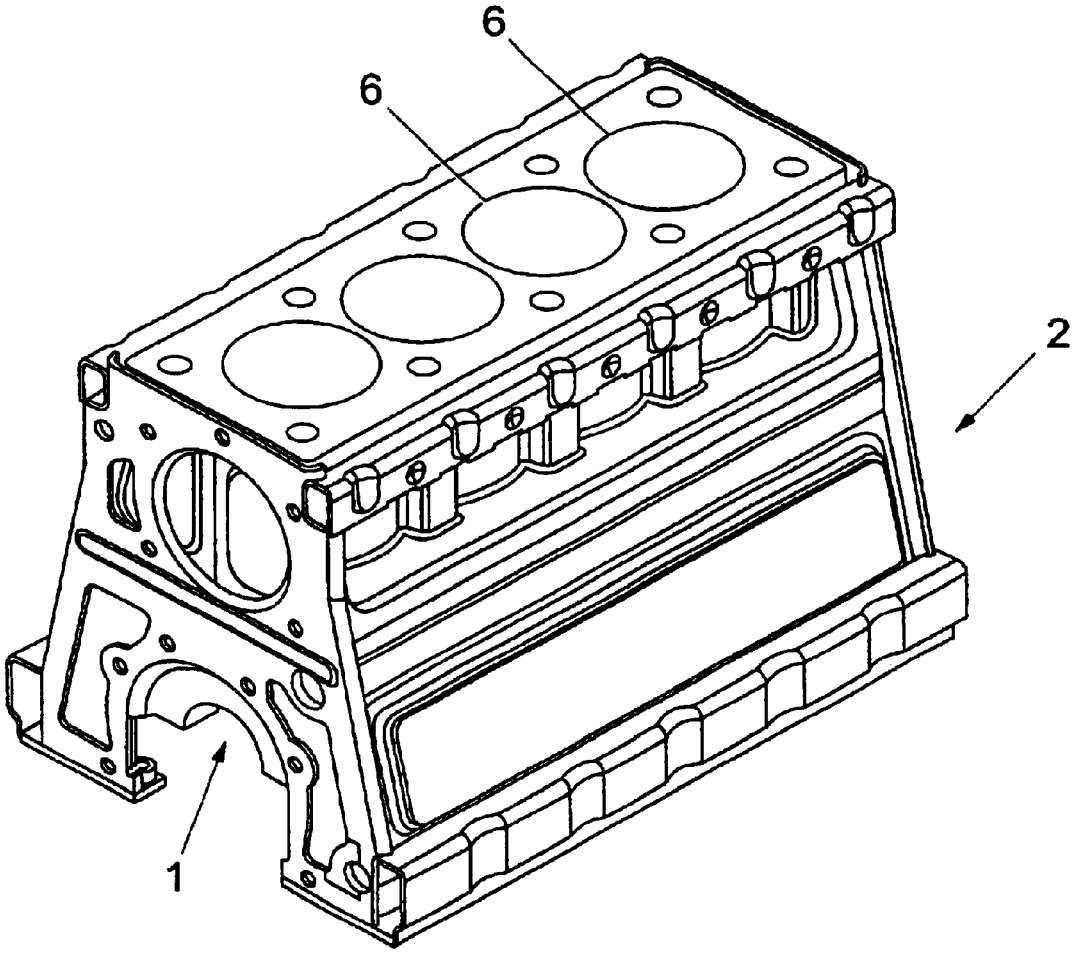
FIG. 1 is an isometric view of an engine cylinder block apparatus including a cast steel core and a high strength low alloy (HSLA) wrought steel frame in accordance with a first embodiment of the present invention.
Figure 2:
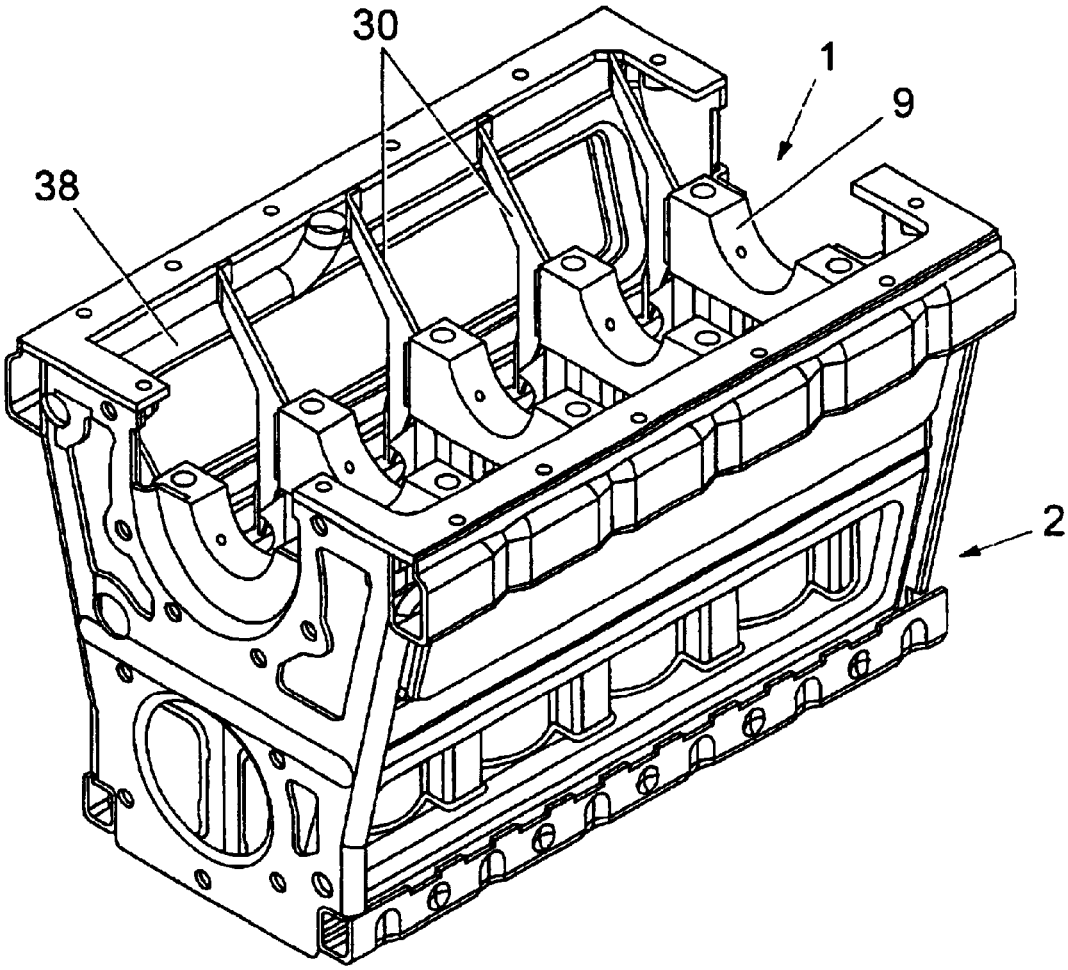
FIG. 2 is an isometric view of the apparatus of FIG. 1 in an inverted position.
Figure 3:
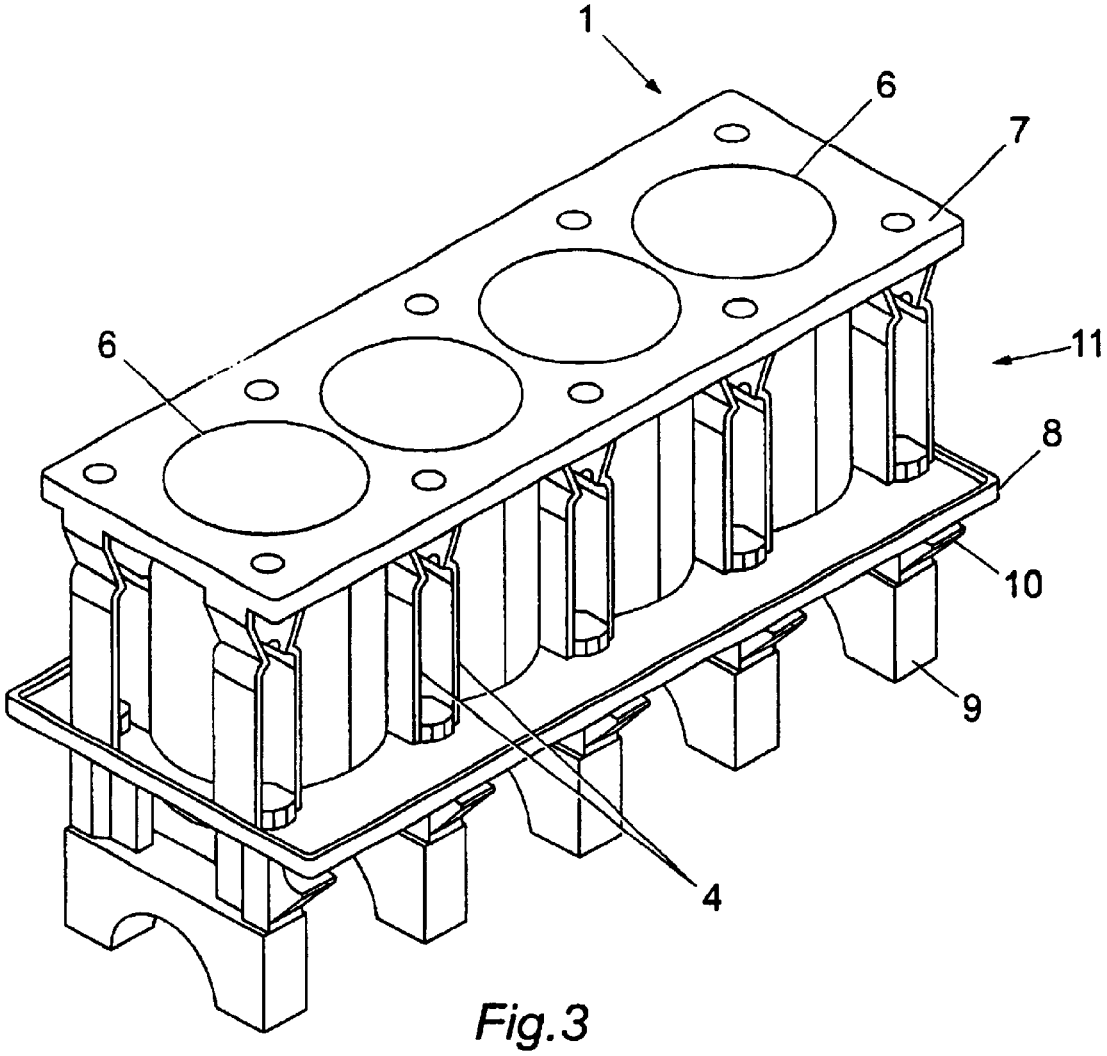
FIG. 3 is an isometric view of the cast steel core of FIG. 1; including web pairs for captivating 'D'-shaped nuts for cylinder head retention.

Referring to the drawings, FIGS. 1 and 2 show a fabricated cylinder block apparatus in accordance with a first embodiment of the present invention. The apparatus includes a cast steel core 1 (shown in isolation in FIG. 3) laser welded to a wrought HSLA steel frame 2 built up from panels and plates as will become clear. Process brazing or adhesive bonding are alternative means of joining the frame components to the core.

The cast core 1 is designed to react all internal loads (gas pressure, bearings, etc.) whilst the frame 2 reacts engine mounting and torque loads and provides attachment for various external parts. Also part of the cast core (FIG. 3) are pairs of webs 4 which serve to enhance the rigidity of the core and provide a captivating means for cylinder head fasteners as will be described in detail in conjunction with FIG. 4.

The frame components may be pre-located on the core for welding by means of tags and slots and/or robotic assembly methods may be used (not shown).

Cast steel has been selected as the preferred material for the core because this material may be cast with relatively thin walls, it has a very high modulus of elasticity compared with cast iron and it can be welded to wrought steel relatively easily. (However there are stipulations which need to be followed when welding HSLA steel as will be described below).

The simple structure of the core facilitates shot blasting for improved fatigue resistance if required and, further, easy cleaning and inspection after casting, shot blasting and/or machining. Reduction of the core casting to the simplest, smallest, basic shape with uniform wall thickness and no hidden cavities will produce the most reliable material properties in which improved confidence, in fatigue stress in particular, will enable the application of higher design stress limits leading inevitably to lighter structures.

The core includes four siamesed cylinders 6, an upper deck 7, a lower coolant jacket 8, upper main bearing supports 9 and lubricating oil pressure rail supports 10. The upper deck and the lower coolant jacket define between them a coolant gallery 11. The upper main bearing supports 9 may subsequently be line bored in conjunction with the main bearing caps (shown as 13 in FIG. 7) in the conventional manner. The core may be part machined before assembly to the frame but final-bore and bearing machining of the core should take place after fabrication.

Each cylinder 6 is joined (siamesed) to its adjacent cylinder for substantially a full cylinder length. Siamesing of engine cylinders provides high structural rigidity and minimises the pitch between cylinder bores. The bore pitch of in-line engines in particular determines overall engine length and weight and hence impacts on noise, vibration and harshness (NVH) performance.

The upper deck 7 serves a conventional dual purpose as a mounting face for a cylinder head (shown as 12 in FIG. 7) and as an upper coolant jacket. Lips of the upper deck 7 and the lower coolant jacket 8 each have a thickness generally equivalent to the thickness of the frame material, for example 3 mm, to facilitate welding to the frame. A particular benefit of including the lower coolant jacket 8 as part of the cast core is that this will provide a basically rectangular profile to simplify the subsequent welding operation.

Figure 4:
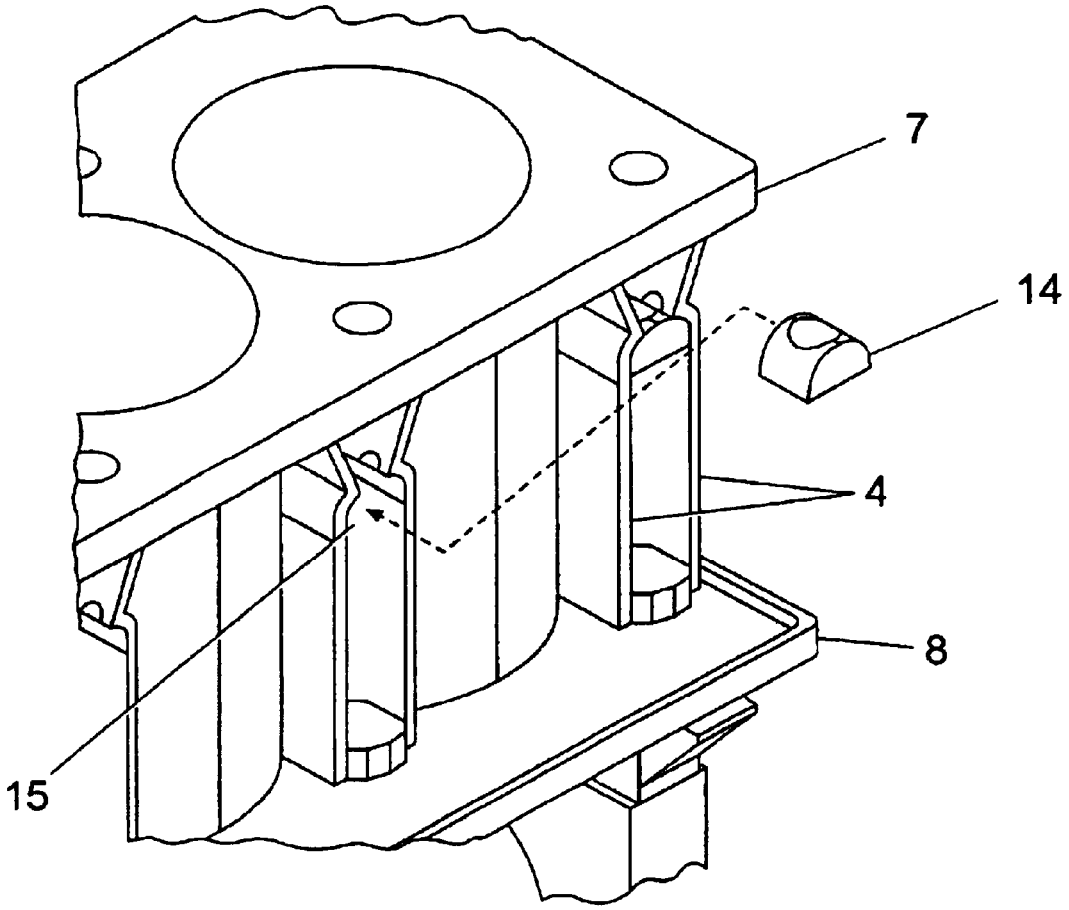
FIG. 4 is an isometric view of a corner section of the cast steel core of FIG. 3.

FIG. 4 shows the means by which pairs of webs 4 may be shaped to retain a 'D'-shaped threaded nut 14 into which a threaded bolt (not shown) may subsequently be screwed to retain the cylinder head. This construction provides a means to share the cylinder head retaining loads between the upper deck 7 and the lower coolant jacket 8 to alleviate distortion of the upper deck. It also reduces the machining of the core that would be required if drilled and tapped holes were to be provided for the cylinder head fasteners and it increases the overall stiffness of the structure.

The separate nature of the 'D'-shaped nuts 14 enables them to be fitted subsequent to machining of the coolant passage which are shown as 18 in FIG. 6 (see below). The nuts are slidingly engaged with cylindrical pockets 15 machined into each pair of webs 4. If the nuts and bolts may become exposed to a corrosive coolant, they will need to be designed not to corrode.

Figure 5:
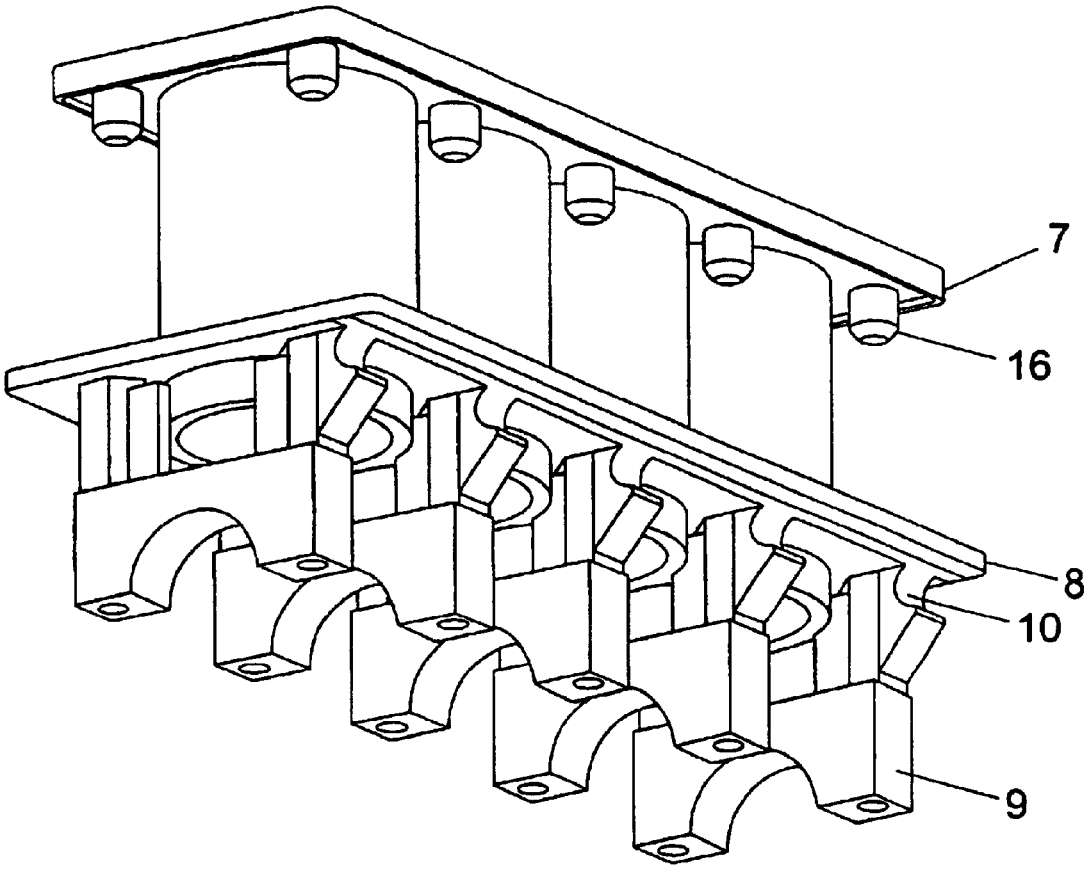
FIG. 5 is an isometric view of a corner section of the cast steel core of FIG. 3 including threaded boss means for cylinder head retention.

FIG. 5 shows an alternative means of retaining the cylinder head wherein the cylinder head bolts (not shown) may threadingly engage with threaded bosses 16 integral with the upper deck 7.

Figure 6:
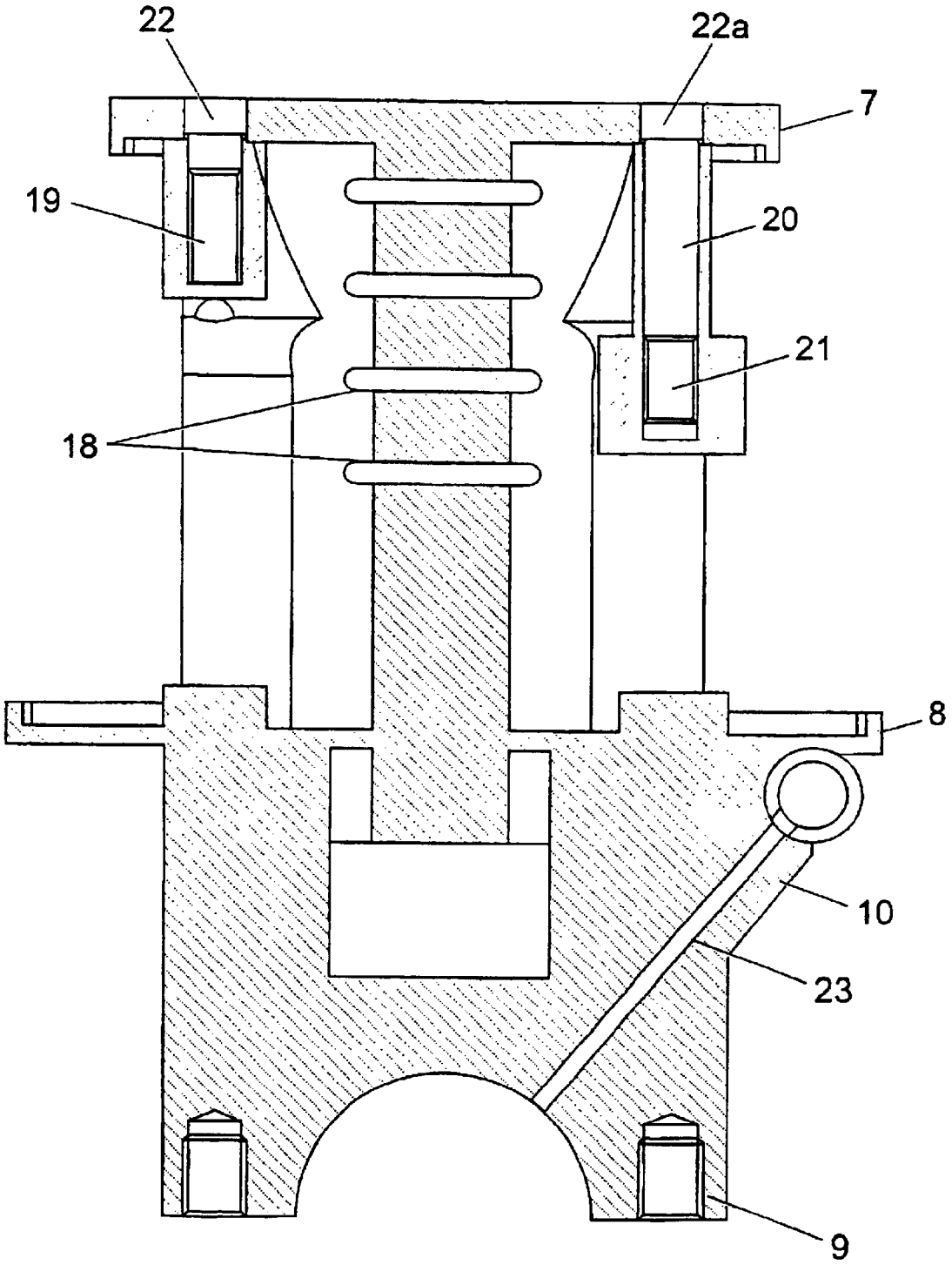
FIG. 6 is a cross-sectional view through the cast steel core of FIG. 1 including cross-drilled holes between adjacent cylinders and further including alternative cylinder head fastening means.

FIG. 6 is a cross-sectional view through the apparatus in which may be seen lateral coolant passages 18 provided between each adjoining cylinder to enable coolant to encircle the cylinders in their hottest region and thus avoid the bore distortion that might otherwise arise from siamesing. In the given example, the coolant passages are drillings of between 5 mm to 7 mm diameter enabling a coolant cross-flow of 3 to 5 m/s. This rate of coolant flow will permit efficient nucleate boiling heat transfer rates whilst preventing film boiling.

In a conventional cylinder block, the provision of small cross drillings between the cylinders is impracticable because extensive drill depths would be required and the external walls would need plugging after drilling. It is also impracticable to cast cross drillings of a sufficiently small diameter for rapid coolant flow.

FIG. 6 also shows two alternative means for cylinder head fastening, specifically a threaded boss 19 or a tube 20 terminating in a threaded boss 21, either of which may be welded to the upper deck 7 in alignment with a cast hole 22, 22*a* through which a threaded bolt (not shown) may be inserted to threadingly engage with the relevant threaded boss. An advantage of the tube terminating in a boss is that a longer and therefore more elastic bolt may be used. Bosses 19, 21 may be designed to exclude the admission of coolant to avoid internal corrosion.

Figure 7:
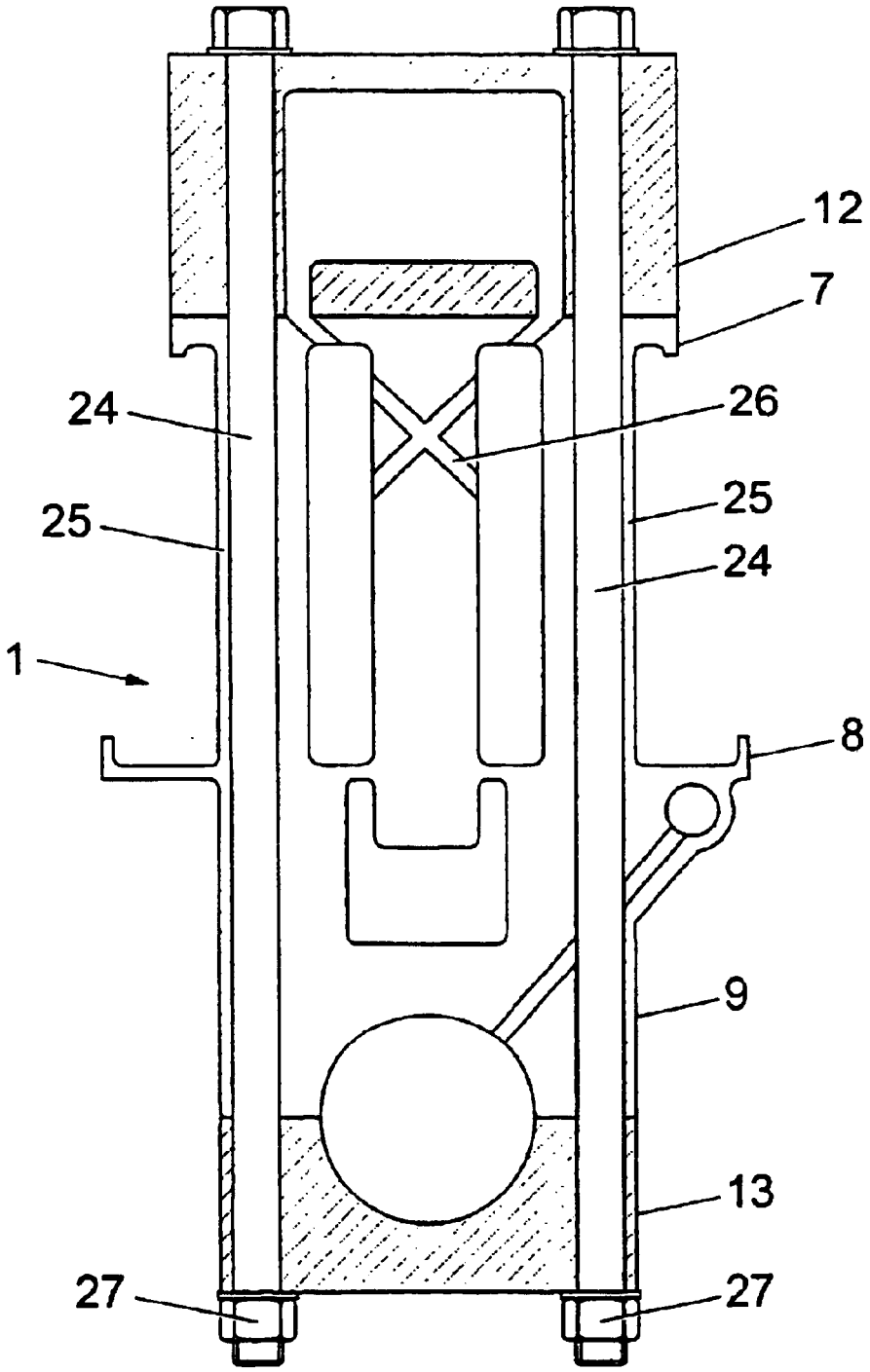
FIG. 7 is a cross-sectional view through an engine including a cast steel core with cast tubes to facilitate cylinder head to main bearing cap retention.

FIG. 7 shows a yet further alternative means of retaining the cylinder head 12. In this instance, the cast core 1 includes integral cast tubes 25 between the upper deck 7 and the lower coolant jacket 8. Cylinder head bolts 24 pass through the upper deck 7, the cast tubes 25, the lower coolant jacket 8, the upper main bearing supports 9, and the main bearing caps 13, and threadingly engage with nuts 27 to retain the main bearing caps 13 and the cylinder head 12 to the core 1. The inclusion of the cast tubes 25 as part of the core 1 will increase overall structural rigidity. Alternatively, the tubes may be cast solid and subsequently drilled or they may be fabricated tubes furnace brazed to the core. A possible disadvantage of casting the tubes as part of the core is that access for cross-drilling the coolant passages 18 as shown in FIG. 6 may not be available and it may therefore be necessary to drill angled passages 26 as shown in FIG. 7.

Figure 8:
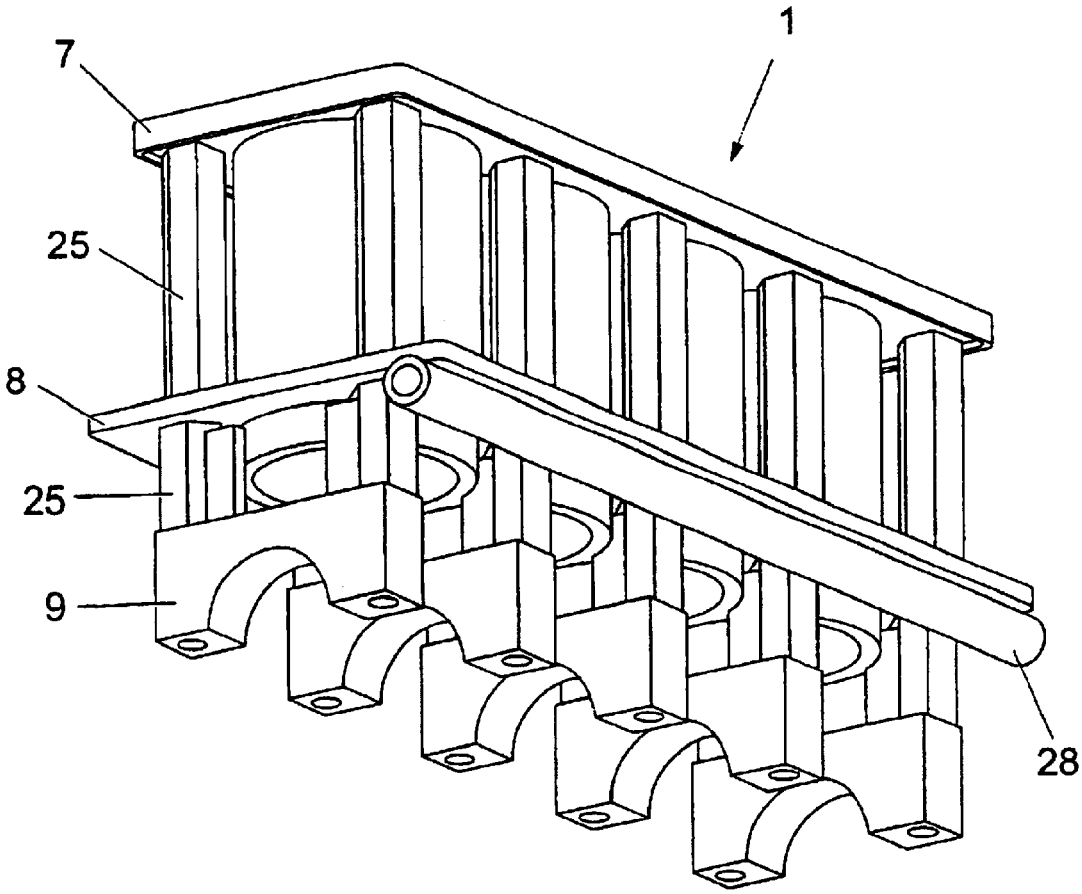
FIG. 8 is an isometric view of the cast core and cast tubes of FIG. 7 and further including a cast-in lubricating oil pressure rail.

FIG. 8 shows an isometric view of the cast core 1 and cast tubes 25 of FIG. 7 with a lubricating oil pressure rail 28 which may also be cast as part of the core.

Figure 9:
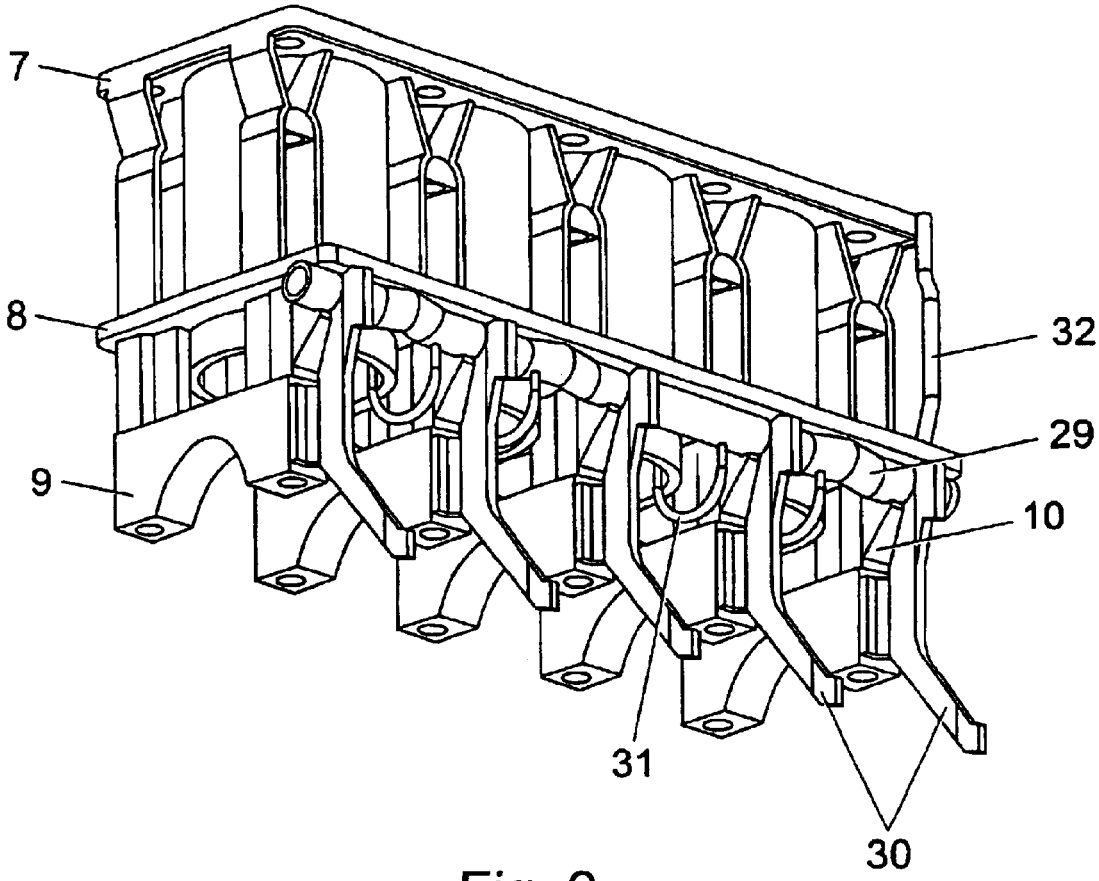
FIG. 9 is an isometric view of the cast steel core of FIG. 3 to which has been assembled a fabricated lubricating oil pressure rail, an oil transfer tube and a series of frame support webs.

FIG. 9 shows a fabricated lubricating oil pressure rail 29 process-brazed to cast-in supports 10 (which may be seen more clearly in FIG. 5) before the frame is welded to the core as an alternative to the cast-in pressure rail 28 shown in FIG. 8. The fabricated pressure rail 29 may be bent before brazing to relieve stresses and may include piston-cooling jets 31. Drilled passages (23 in FIG. 6) connect the upper main bearing supports with the lubricating oil pressure rail supports. An oil transfer tube 32 for transfer of lubricating oil from the oil pressure rail to upper areas of the engine and an oil drain tube (not shown) between and through the upper deck 7 and lower coolant jacket 8 may be process brazed to the core.

If process brazing is adopted for retaining the pressure rail, transfer tube or any other components, care must be taken to ensure that the heat generated by subsequent welding in the vicinity does not remelt the brazing material, though the prospect of this is reduced if laser welding is employed.

Also shown in FIG. 9 is a series of frame support webs 30 made from wrought sheet steel which may be process brazed or welded to the lower coolant jacket and the upper main bearing supports. In this example, the webs also provide increased support for the pressure rail.

Figure 10:
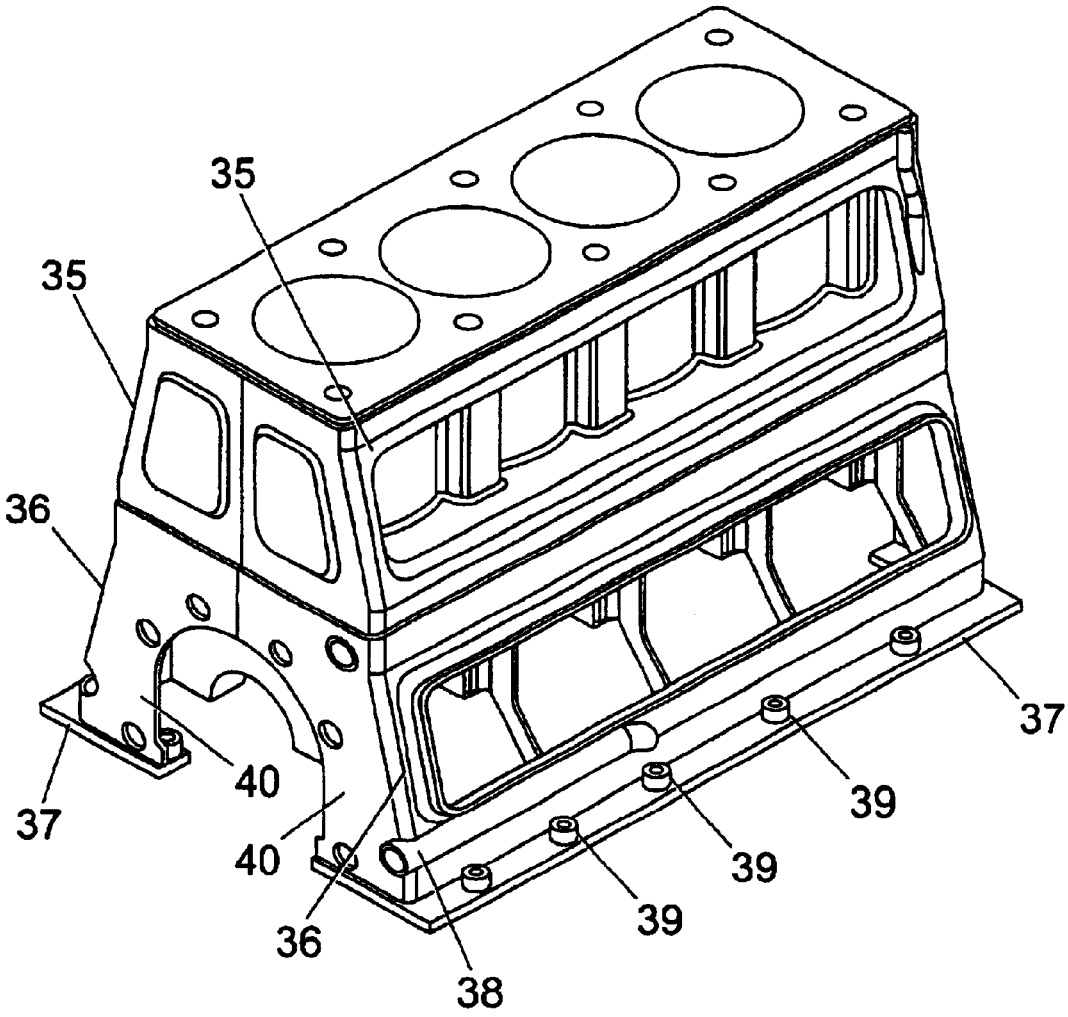
FIG. 10 is an isometric view of the apparatus of FIG. 9 to which has been assembled wrought steel coolant jacket side panels, crankcase side panels, bottom plates including sump-retaining weldnuts and an integrated oil pick-up conduit.

FIG. 10 shows a pair of coolant jacket side panels 35, a pair of crankcase side panels 36, and a pair of bottom plates 37 located adjacent to, and laser welded to, the core. The panels and plates may be positioned before welding by locating tabs and slots, robotic means or other conventional jigging (not shown).

It should be noted that welding temperatures may affect the physical properties of HSLA steel and it is important that this is taken into account in the design and manufacturing processes. Preferably the frame components should be configured so that welding will not be applied in highly stressed areas and laser welding is a preferred welding means since this will minimise distortion and heat damage to the material of the frame components.

The coolant jacket and crankcase side panels may be configured as tailored blanks where it is desired to maintain a relatively low mass combined with high strength. In the example shown in FIG. 11, a coolant jacket side panel 35 is formed as an outer panel 41 of 2 mm HSLA steel with wrapped ends 42 and pierced with end windows 43 and side window 45 before laminating or insetting with an inner 1 mm thick panel 46 of deep drawing steel. The inner and outer panels are laser welded together and pressed into the outer coolant jacket shape, the windows 43 and 45 being closed off by the inner panel 46.

The inner panel 46 may include form-shaped 'blockages' 47 which, in use, will control the volume, velocity and flow direction of coolant within the cylinder block. The combined thickness of metal at the ends of the panel is, in the example, 3 mm which is appropriate for laser welding to the core. The coolant jacket side panels are seam welded to the upper deck and lower coolant jacket and their adjacent edges may be seam welded one to the other. The rectangular cast profile of the upper deck and lower coolant jacket is of paramount benefit for seam welding.

Figure 11A:
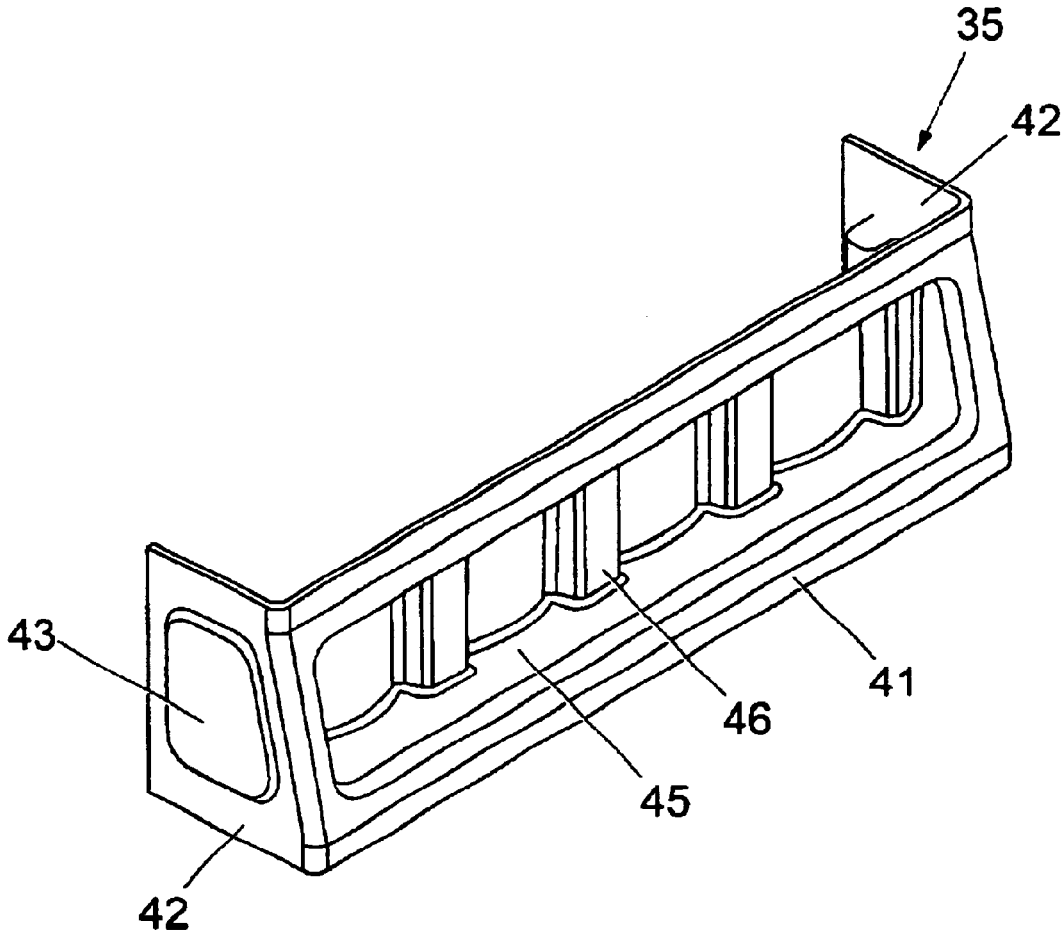
FIG. 11(*a*) is a first isometric view of the coolant jacket side panel of FIG. 10.
Figure 11B:
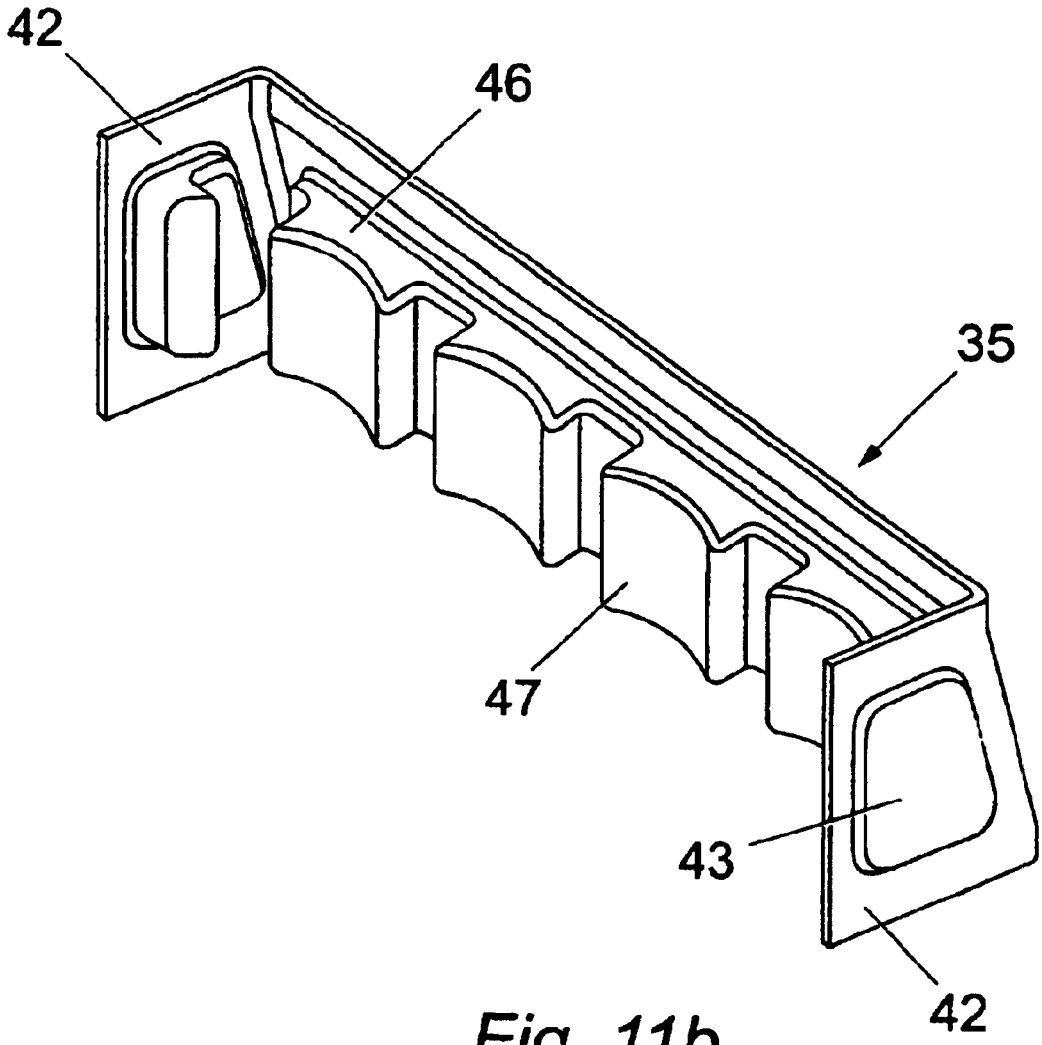
Figure 12A:
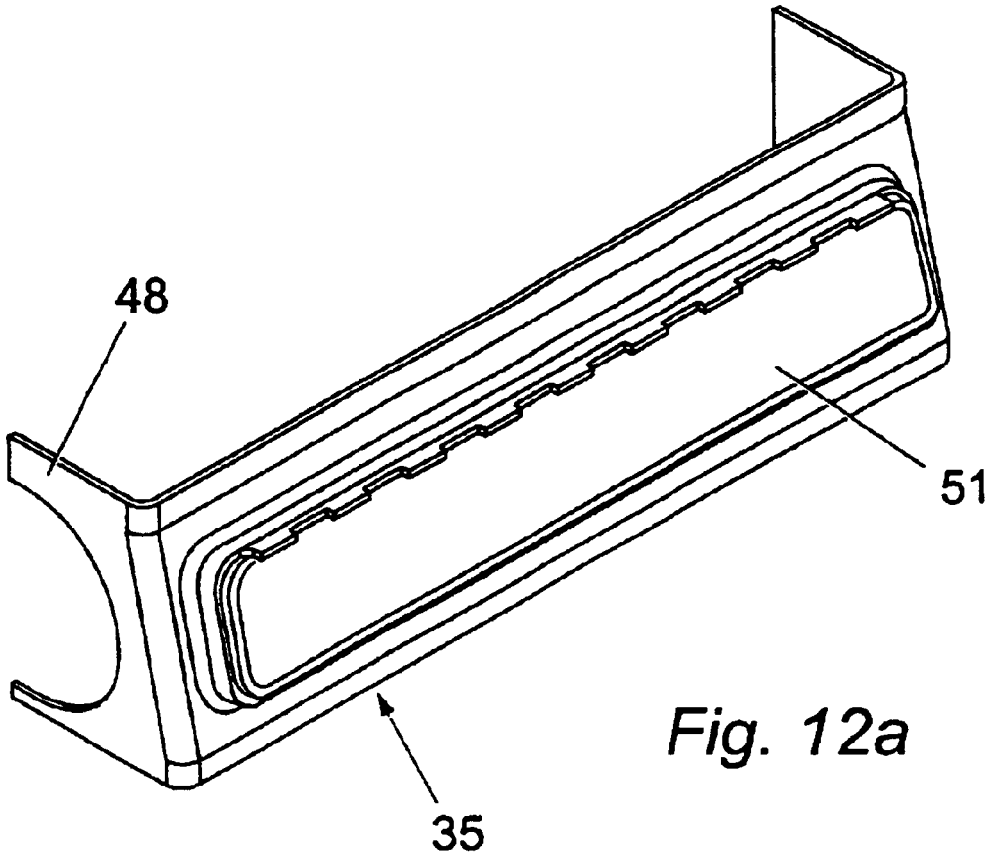
FIG. 12(*a*) is a first isometric view of an alternative coolant jacket side panel to which has been assembled an enclosure panel.
Figure 12B:
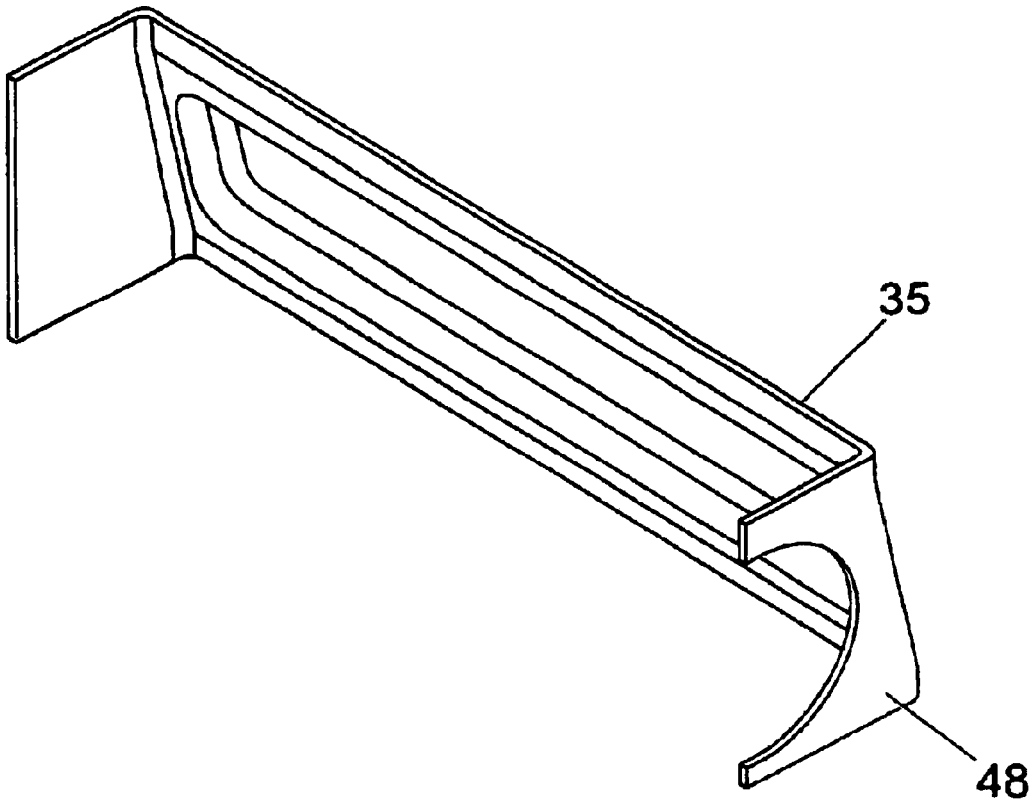

Referring to the alternative arrangement in FIG. 12, one wrapped end 48 of each coolant jacket side panel may be shaped to form part of a coolant inlet port into the cylinder block as an alternative to the fully closing wrapped ends 42 of the side panels of FIG. 11.

The crankcase side panels (36 shown in FIG. 10) may also be constructed as tailored blanks (not shown) in a similar manner to that described for the coolant jacket side panels. The crankcase side panels have wrapped ends 40 similar to the coolant jacket side panels and are welded to the lower coolant jacket, the frame support webs and one to the other at adjacent edges. One of the crankcase side panels may include an integral oil pick-up pipe 38 (FIGS. 2 and 10).

Bottom plates 37 (FIG. 10) are welded to the base of the crankcase side panels to provide a lower deck for the sump (not shown) to engage with. The bottom plates include fasteners for the sump in the form of weldnuts 39 or other proprietary nuts welded, brazed or mechanically affixed to the plates in alignment with previously pierced holes. The provision of weldnuts in co-operation with pierced holes will provide cost savings when compared with drilled and tapped holes. A further advantage is that a high number of small diameter fasteners may provide better sealing with less weight than may be the case with a relatively smaller number of larger diameter fasteners.

Figure 13:
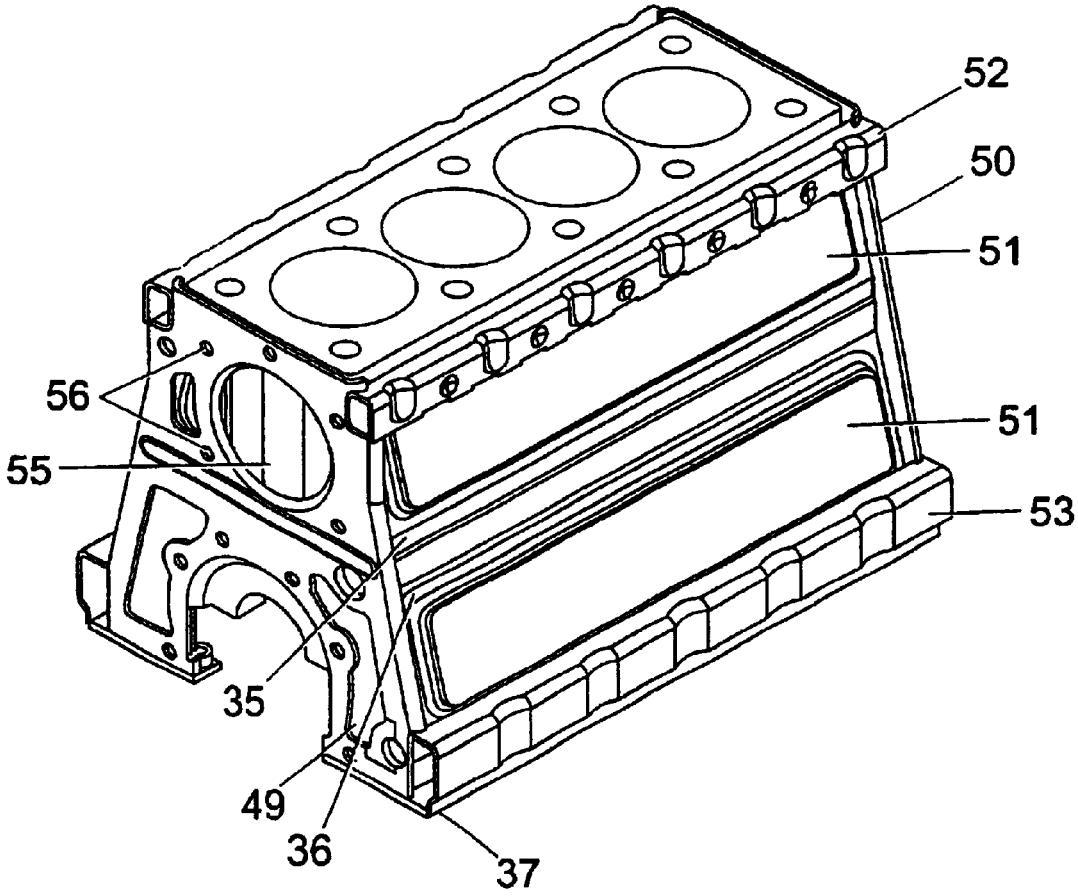
FIG. 13 is an isometric view of the apparatus of FIG. 10 to which has been assembled front and rear panels, upper acoustic enclosure panels and lower acoustic or non-acoustic enclosure panels and upper and lower side-rails.

Referring to FIG. 13, front and rear panels 49, 50 may be welded to the apparatus over the top of the folded ends of the coolant jacket and crankcase side panels to provide a very rigid 'doubled' structure with an overall panel thickness suitable for fastening thereto engine ancillaries and brackets (not shown). The front panel 49 may include an aperture 55 to provide a coolant inlet port into the cylinder block and may further include fastening means (the screw holes 56) on which to locate a coolant pump.

Enclosure panels 51 may be welded, brazed or adhesively bonded to the side panels. The enclosure panels may include noise attenuation means if required, for example a metal/polymer/metal laminate or a pressing shaped to attenuate noise. The enclosure panels may also function as fluid retention jackets where the side panels are of the open type as in the example of the crankcase side panel of FIG. 10.

Alternatively, a recess defined by the coolant jacket side panel and the relevant enclosure panel may be fully or partly filled with a noise-attenuating material (not shown) where it is desired to reduce noise emissions from the engine.

Upper side rails 52 may be welded to the coolant jacket side panels 35 and lower side rails 53 may be welded to the crankcase side panels 36 and/or the bottom plates 37 to increase the stiffness and frequency mode of the apparatus. The side rails 52, 53 may be deformed (dimpled) in situ after fabrication to apply a pre-load to plastically deform the structure to resist distorting forces. Selective deformation of the side rails may also provide stress relief in the welded joints to improve fatigue performance. The side rails may also be configured to carry fluids or enclose cables or conduits.

Figure 14:
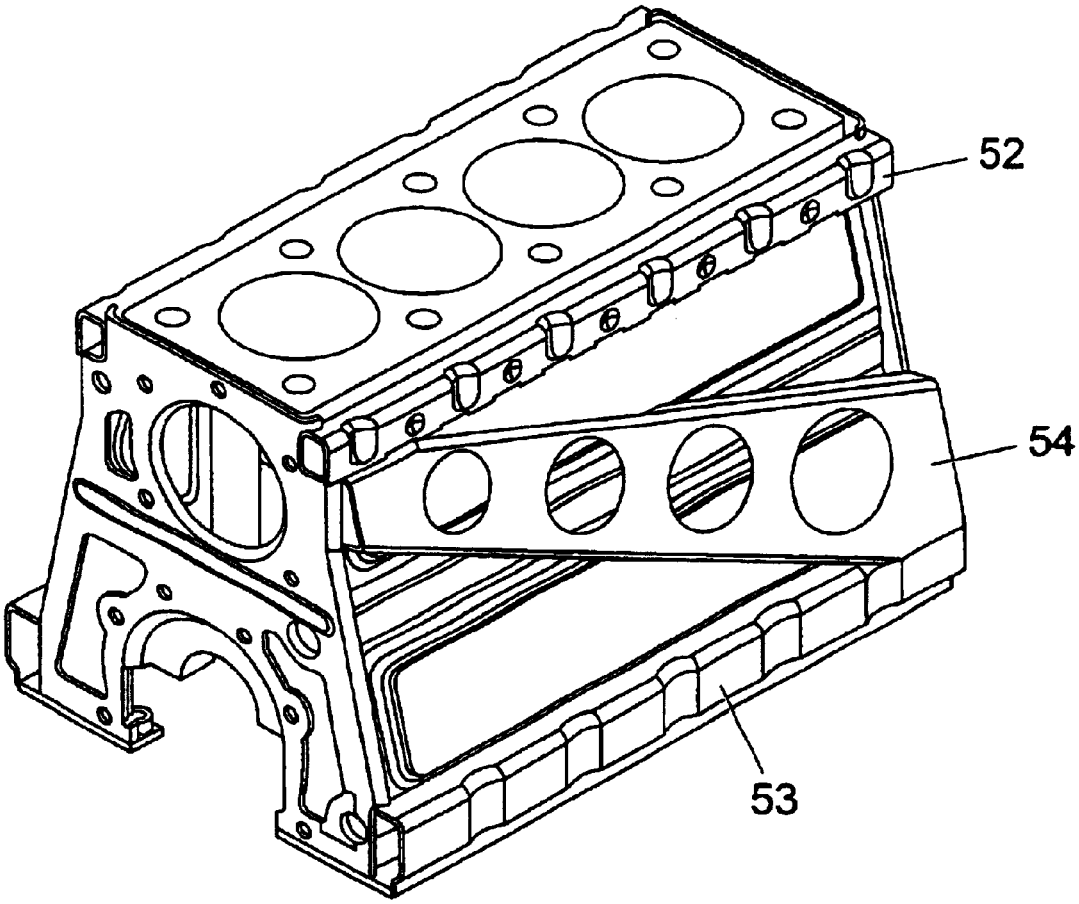
FIG. 14 is an isometric view of the apparatus of FIG. 13 further including a diagonal brace.

Referring to FIG. 14, a diagonal brace 54 may be welded to one or both sides of the apparatus in place of or in addition to the side rails to add stiffness.

The various panels and plates may be customised to suit the vehicle to which the engine is to be fitted. Such vehicles could be as diverse as a passenger car or a boat where the engine may be flexibly mounted, a generating set or a fork lift truck where the engine may be rigidly mounted or an agricultural tractor where the engine may be adapted as an integral part of the chassis.

In the case of an agricultural tractor where a front axle may be mounted directly on the engine, the frame could be of a very strong construction. However, where the engine is to be flexibly mounted in a light passenger car, the frame could be of relatively light construction and, further, could be configured to deform plastically and controllably in the event of a severe impact and thereby contribute to the crumple performance of the vehicle. The design could include the feature that, where the impact was particularly severe, break up of the core would commence only after the frame had absorbed a significant amount of the vehicle impact energy.

The present invention provides for customisation far more easily and economically than a conventional cast cylinder block for which a variety of expensive pattern equipment may need to be provided for different cylinder block configurations. Further, the core could be configured by multiple competitive vehicle manufacturers for adaptation to their own needs. That is, the core could be manufactured and marketed as a proprietary component for competitive engines in much the same way as may be seen with adaptable and proprietary fuel injection systems. Thus production volumes of cast cores could be maintained at high levels and correspondingly low unit cost.

The apparatus may include the integration of brackets into the structure for alternator, filters, engine mountings, engine lifting eyes and other conventional externally mounted components to reduce the requirement for threaded fastening and thus reduce costs and improve the integrity of the built engine in use.

Although laser welding has been described as the preferred method of fusion welding together the apparatus, spot welding or electron beam welding could also be considered, the objective being to choose processes that will minimise grain growth and thermal distortion.

Figure 15:
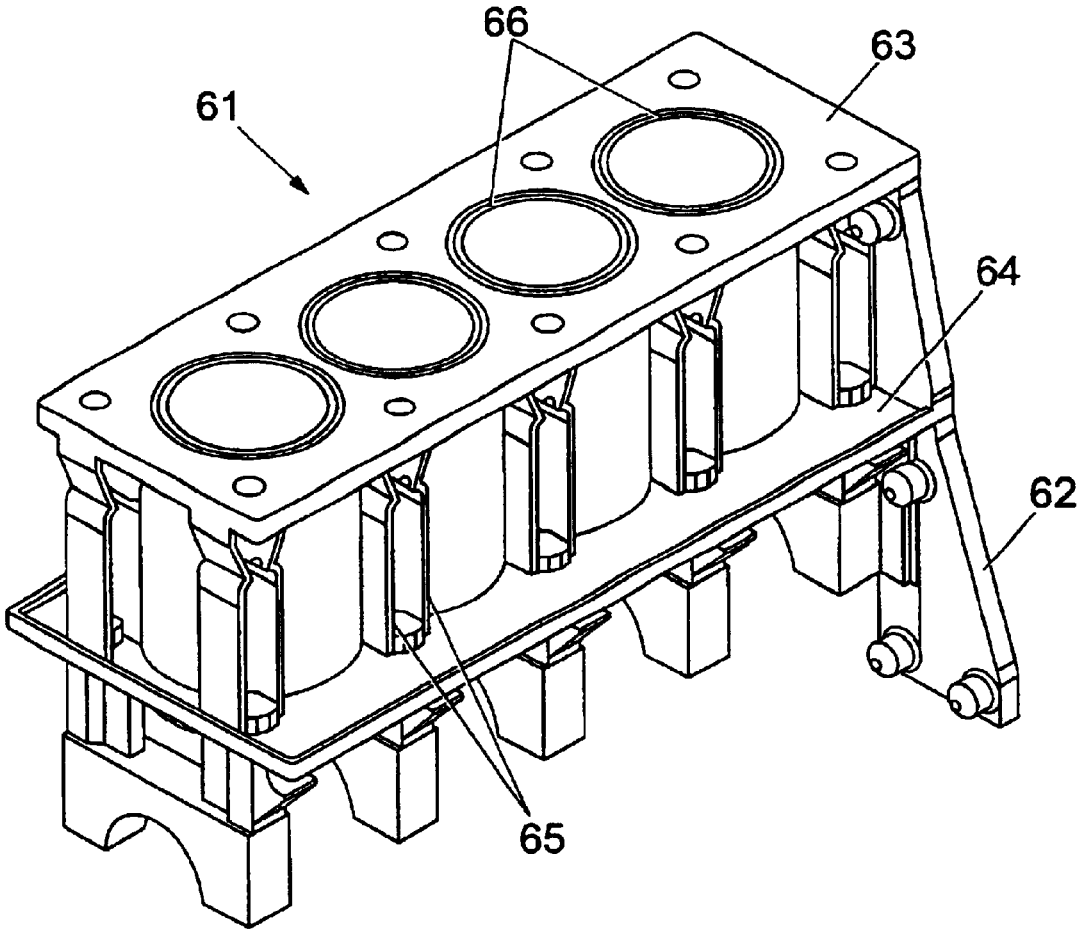
FIG. 15 is an isometric view of a cast aluminium core in accordance with a second embodiment of the present invention.

The cylinder block of the present invention may alternatively be built up as a cast light alloy core with wrought light alloy frame by using appropriate methods of welding or adhesive bonding. As shown in FIG. 15, it may be preferable to include the rear plate 62 as an integral part of the cast core 61 because an aluminium rear plate needs to be relatively substantial. The upper deck 63, lower coolant jacket 64 and pairs of webs 65 may also need to be thicker and it is probable that steel cylinder liners 66 will need to be fitted. In other general respects, the description given for the cast steel core with wrought steel frame will also apply to a light alloy apparatus.

What is claimed is:

1. A method for fabricating a cylinder block for an internal combustion engine comprising the following steps:

a cylinder core including one or more cylinders is manufactured by casting;

the remainder of the cylinder block structure is manufactured as a wrought framework; and the wrought framework is joined to the already cast core;

including the further step of attaching enclosure panels to the cylinder block to form an enclosed structure.

2. A method in accordance with claim 1 wherein the core is cast from steel.

3. A method in accordance with claim 1 wherein the core is cast from a light alloy.

4. A method in accordance with claim 2 wherein the framework is fabricated from high strength low-alloy steel.

5. A method in accordance with any preceding claim wherein the wrought framework is joined to the cast core by a process selected from welding, adhesive bonding and process brazing.

6. A method in accordance with any one of claims 1 to 4 wherein the core is cast to include a lower coolant jacket.

7. A method in accordance with claim 6, wherein the core is cast to further include upper main bearing supports, support means for a cylinder head, and support means for a lubricating oil pressure rail.

8. A method of manufacturing an internal combustion engine comprising the steps of fabricating a cylinder block in accordance with the method of any one of claims 1 to 4 and fitting the cylinder block in said internal combustion engine.

9. A method of manufacturing a vehicle comprising the steps of manufacturing an internal combustion engine in accordance with the method of claim 8 and fitting the internal combustion engine onto said vehicle.

10. A method in accordance with claim 1 wherein the enclosure panels include noise attenuation means.

11. A method for fabricating a cylinder block for an internal combustion engine comprising the following steps:

a cylinder core including one or more cylinders is manufactured by casting;

the remainder of the cylinder block structure is manufactured as a wrought framework; and the wrought framework is joined to the already cast core;

wherein stiffening rails are attached to the fabricated framework to increase the stiffness and frequency mode of the cylinder block apparatus.

12. A method in accordance with claim 11 wherein the core is cast from steel.

13. A method in accordance with claim 11 wherein the core is cast from a light alloy.

14. A method in accordance with claim 12 wherein the framework is fabricated from high strength low-alloy steel.

15. A cylinder block for an Internal combustion engine comprising a cast cylinder core including one or more cylinders, a wrought cylinder block framework comprising substantially the remainder of the cylinder block which is joined to the already cast core, and enclosure panels attached to the cylinder block to form an enclosed structure.

16. A cylinder block in accordance with claim 15, wherein the core is cast from steel.

17. A cylinder block in accordance with claim 16 wherein the framework is fabricated from high strength low-alloy steel.

18. A cylinder block in accordance with claim 15, wherein the core is cast from a light alloy.

19. A cylinder block in accordance with claim 15 wherein the enclosure panels include noise attenuation means.

20. A cylinder block in accordance with any one of claims 15 to 17 wherein the core includes a lower coolant jacket.

21. A cylinder block in accordance with claim 20, wherein the core further includes upper main bearing supports, support means for a cylinder head, and support means for lubricating oil pressure rail.

22. A cylinder block in accordance with any one of claims 15 to 17 further comprising means to engage the cylinder block with a cylinder head and means to engage the cylinder block in position on a lower part of an engine.

23. A cylinder block in accordance with claim 22 wherein the engagement means comprise means to facilitate through fastening of a cylinder head to a lower part of an engine.

24. A cylinder block in accordance with claim 22 including captive fasteners to minimise screw thread machining operations.

25. An internal combustion engine fitted with a cylinder block in accordance with any one of claims 13 to 16.

26. A vehicle fitted with the internal combustion engine of claim 25.

27. A cylinder block for an internal combustion engine comprising a cast cylinder core including one or more cylinders, and a wrought cylinder block framework comprising substantially the remainder of the cylinder block which is joined to the already cast core; wherein the fabricated framework includes stiffening rails to increase the stiffness and frequency mode of the cylinder block apparatus, which stiffening rails are preloaded to resist distorting forces by the application of plastic deformation in situ.

28. A cylinder block in accordance with claim 27 wherein the core is cast from steel.

29. A cylinder block in accordance with claim 28 wherein the framework is fabricated from high strength low-alloy steel.

30. A cylinder block in accordance with claim 27 wherein the core is cast from a light alloy.

31. A method for fabricating a cylinder block for an internal combustion engine comprising the following:

casting a cylinder core including one or more cylinders;

joining at least one open framework structure to the cylinder core after the casting of the cylinder core, the open framework structure being manufactured by a wrought process;

joining at least one enclosure panel to the at least one open framework structure; and attaching stiffening rails to the at least one open framework structure.

32. A method in accordance with claim 31, wherein substantially all of the components coupled to the cylinder core are manufactured by a wrought process.

33. A method in accordance with claim 31, wherein the core is cast from steel.

* * * * *